US006527316B1

(12) United States Patent
Agostini et al.

(10) Patent No.: US 6,527,316 B1
(45) Date of Patent: Mar. 4, 2003

(54) VEHICLE DOOR HANDLE

(75) Inventors: Astorre Agostini, Alpignano (IT); Fiorenzo Savant, Collegno (IT)

(73) Assignee: Valeo Sicurezza Abitacolo S.p.A., Santena (IT)

( * ) Notice: Subject to any disclaimer, the term of this patent is extended or adjusted under 35 U.S.C. 154(b) by 0 days.

(21) Appl. No.: 09/522,299

(22) Filed: Mar. 9, 2000

(30) Foreign Application Priority Data

Mar. 12, 1999 (IT) ..... TO990043 U

(51) Int. Cl.[7] ..... E05B 1/00

(52) U.S. Cl. ..... 292/347; 292/348; 292/336.3; 340/426; 340/541

(58) Field of Search ..... 292/336.3, 347, 292/DIG. 31, 348; 382/115; 340/426, 562, 541; 307/10.1; 361/600

(56) References Cited

U.S. PATENT DOCUMENTS

| | | | | |
|---|---|---|---|---|
| 5,682,135 | A | * 10/1997 | Labonde | 340/426 |
| 5,793,881 | A | * 8/1998 | Stiver et al. | 382/115 |
| 6,072,403 | A | * 6/2000 | Iwasaki et al. | 340/825.31 |
| 6,075,294 | A | * 6/2000 | Van de Boom et al. | 307/10.1 |
| 6,239,693 | B1 | * 5/2001 | Benard et al. | 296/146.7 |

FOREIGN PATENT DOCUMENTS

| | | | | |
|---|---|---|---|---|
| DE | 4212291 | C2 * | 10/1993 | |
| DE | 19617038 | A1 * | 11/1997 | |
| DE | 19617038 | | 11/1997 | |
| DE | 19633894 | | 2/1998 | |
| FR | 0831194 | A1 * | 3/1998 | |
| FR | 2772818 | A1 * | 6/1999 | |
| FR | 2781247 | * | 1/2000 | ..... E05B/49/00 |
| IT | 0903453 | A2 * | 3/1999 | |
| WO | 9919585 | | 4/1999 | |

OTHER PUBLICATIONS

Patent Abstracts of Japan, Pub. No. 09184156, Pub. Date Jul. 22, 1997.

English Abstract of German Pat. No. 196 17 038.

English Abstract of German Pat. No. 196 33 894.

* cited by examiner

*Primary Examiner*—William L. Miller
*Assistant Examiner*—André L. Jackson
(74) *Attorney, Agent, or Firm*—Liniak, Berenato & White

(57) ABSTRACT

A vehicle door handle wherein a lever, operated manually by a user, has a core having a seat and an aerial housed inside the seat and for identifying the user; the seat being insulated from the outside by at least one continuous layer of thermoplastic material at least partly surrounding the core and separated from the aerial by at least one spacer body.

6 Claims, 3 Drawing Sheets

VEHICLE DOOR HANDLE

The present invention relates to a vehicle door handle.

More specifically, the present invention relates to a handle of the type comprising a connecting structure fitted to the vehicle door; a lever hinged to the connecting structure and operated, in use, by a user to open a lock on the door; and a detecting aerial housed inside the lever to identify the user.

BACKGROUND OF THE INVENTION

In most applications, the lever is formed, normally molded, in one piece, and has a seat for the aerial, which is inserted inside the seat through an insertion opening formed in the lever and closed by a respective cover with the interposition of seals and/or the formation of sealing labyrinths. The aerial has its own electric wiring, which extends through a passage formed in the lever and projects outwards through a further opening normally different from the aerial insertion opening.

Known handles of the above type have several drawbacks, all due to the design characteristics of the lever, in which, above all, the aerial is never completely sealed off from the outside and therefore normally operates in a damp environment, which rapidly impairs reliability and efficiency. Besides involving a good deal of time and cost to produce or assemble, the openings, cover, labyrinths and seals do not permit levers to be formed with seamless outer surfaces, i.e. with no breaks such as lines, gaps or recesses, which, as is known, are very often undesired, especially for purely aesthetic reasons.

SUMMARY OF THE INVENTION

It is an object of the present invention to provide a vehicle door handle designed to solve the above problems in a straightforward, low-cost manner.

According to the present invention, there is provided a handle for a vehicle door, the handle comprising a movable member operated manually by a user to control, in use, a lock on said door, and said movable member comprising a strengthening body, a seat formed in said strengthening body and having a respective access opening, detecting means for identifying the user and housed inside said seat through said access opening, and closing means for closing said access opening; characterized in that said closing means comprise at least one continuous layer of material at least partly surrounding said strengthening body and sealing said seat in fluidtight manner.

In the handle as defined above, said closing means preferably also comprise at least one spacer body interposed between said detecting means and said layer of material to separate the detecting means from said layer of material. The spacer body is conveniently made of insulating material.

BRIEF DESCRIPTION OF THE DRAWINGS

A non-limiting embodiment of the invention will be described by way of example with reference to the accompanying drawings, in which.

DETAILED DESCRIPTION OF THE INVENTION

Figure 1:
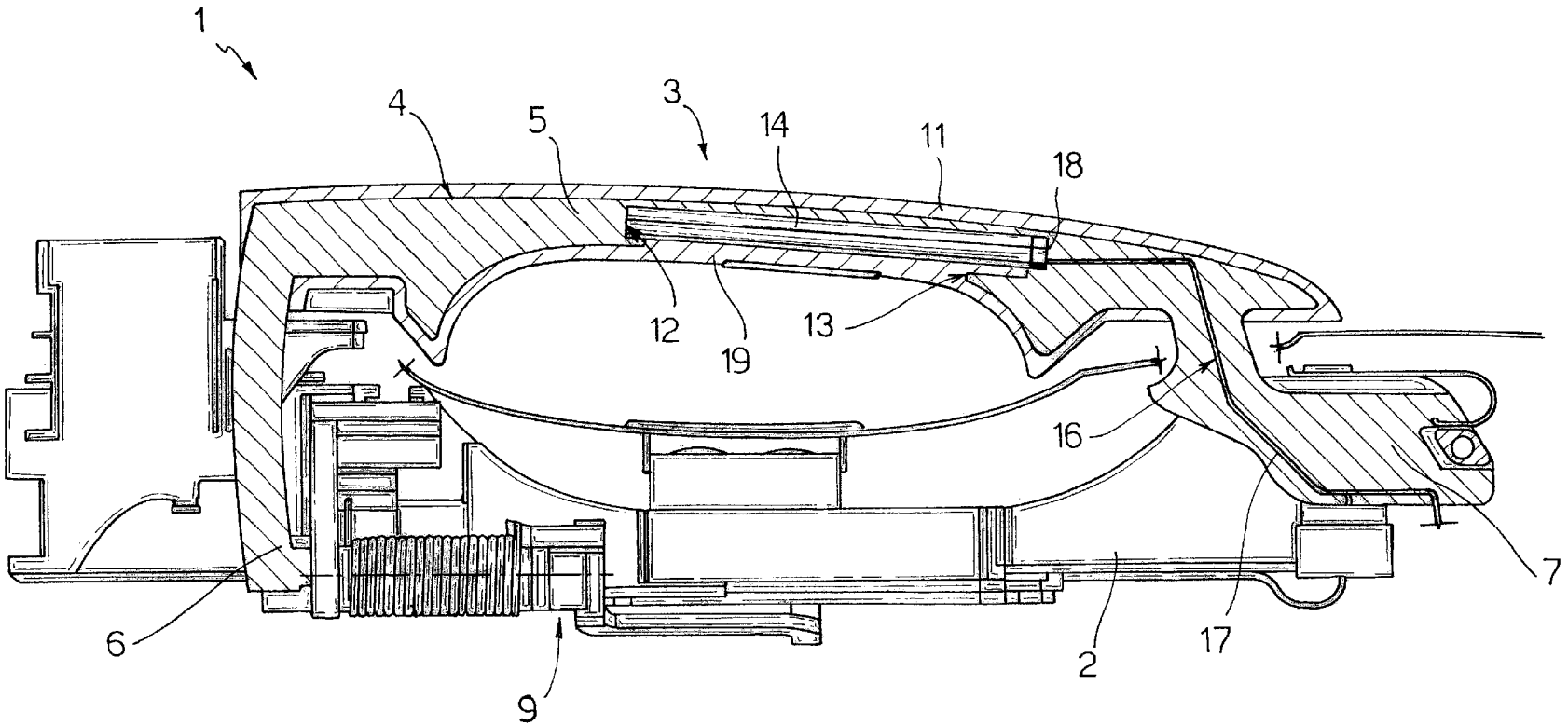
FIG. 1 shows a section of a preferred embodiment of the handle according to the present invention.

Number 1 in the accompanying drawings indicates a handle for controlling a lock on a vehicle door (not shown).

Handle 1 comprises a connecting body 2 connected to the vehicle door (not shown); and a lock operating lever 3. Lever 3, in turn, comprises a strengthening body 4 conveniently made of plastic material and, in turn, comprising an intermediate grip portion 5 projecting, in use, outwards of the door and gripped by the user's hand, and two lateral portions 6 and 7 extending crosswise to portion 5 and inside connecting body 2; portion 7 being hinged to connecting body 2 to rotate about a hinge axis; and portion 6 being connected to a known lock control transmission 9 not described in detail.

Intermediate grip portion 5 is covered with a continuous layer 11 of known thermoplastic material preferably deposited directly or co-molded onto portion 5, and partly defines a seat 12 having a respective access opening 13 and housing a known detecting aerial 14, not described in detail, for identifying the user or owner of the vehicle. Aerial 14 is connected by wiring 16 to a known processing and control unit not described in detail 16.

In the FIG. 1 embodiment, wiring 16 comprises a cable 17 embedded in portion 7, and a known connector 18 housed inside seat 12; and opening 13 is closed in fluidtight manner by an intermediate portion 19 of cover layer 11.

Handle 1 is produced by first forming—preferably molding—body 4, in which cable 17 is embedded during the forming process, with respective connector 18 housed inside seat 12. Aerial 14 is then inserted inside seat 12 and connected to connector 18; and layer 11 of covering material is then formed—conveniently molded—so that portion 19 permanently closes opening 13 to seal aerial 14 inside a fully and permanently sealed chamber.

Figure 2:
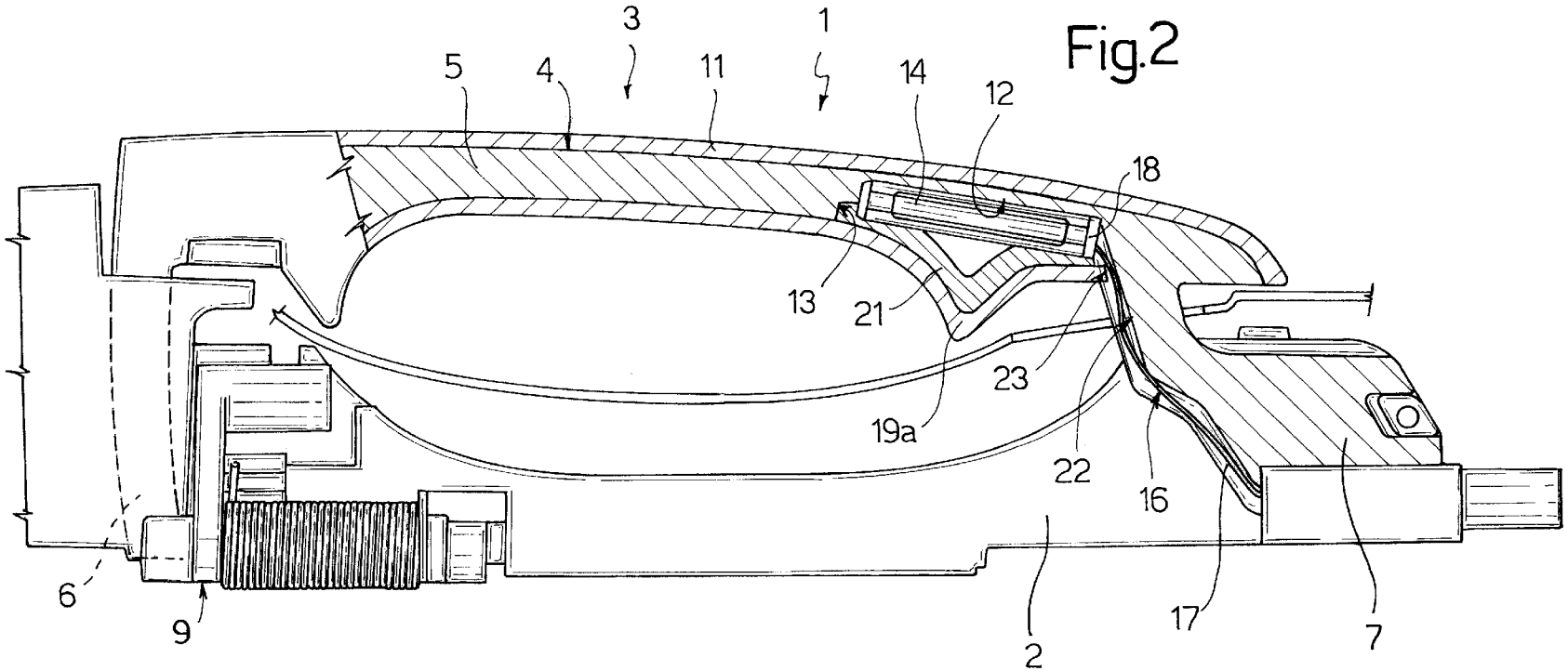
FIGS. 2 and 3 show views similar to FIG. 1, of two different variations of a FIG. 1 detail.

In the FIG. 2 variation, a spacer body 21, conveniently made of thermally or other insulating material, is interposed between aerial 14 and intermediate portion 19*a* of layer 11 closing opening 13, and is inserted inside opening 13 to partly define seat 12 and separate aerial 14 from portion 19*a* of layer 11.

In the FIG. 2 variation, seat 12 communicates with a channel 22, which extends along portion 7, is defined partly by body 21, and is engaged by cable 17. An intermediate portion of channel 22 close to seat 12 is sealed in fluidtight manner by a portion 23 of layer 11, which fully occupies the gap left in channel 22 by cable 17.

Figure 3:
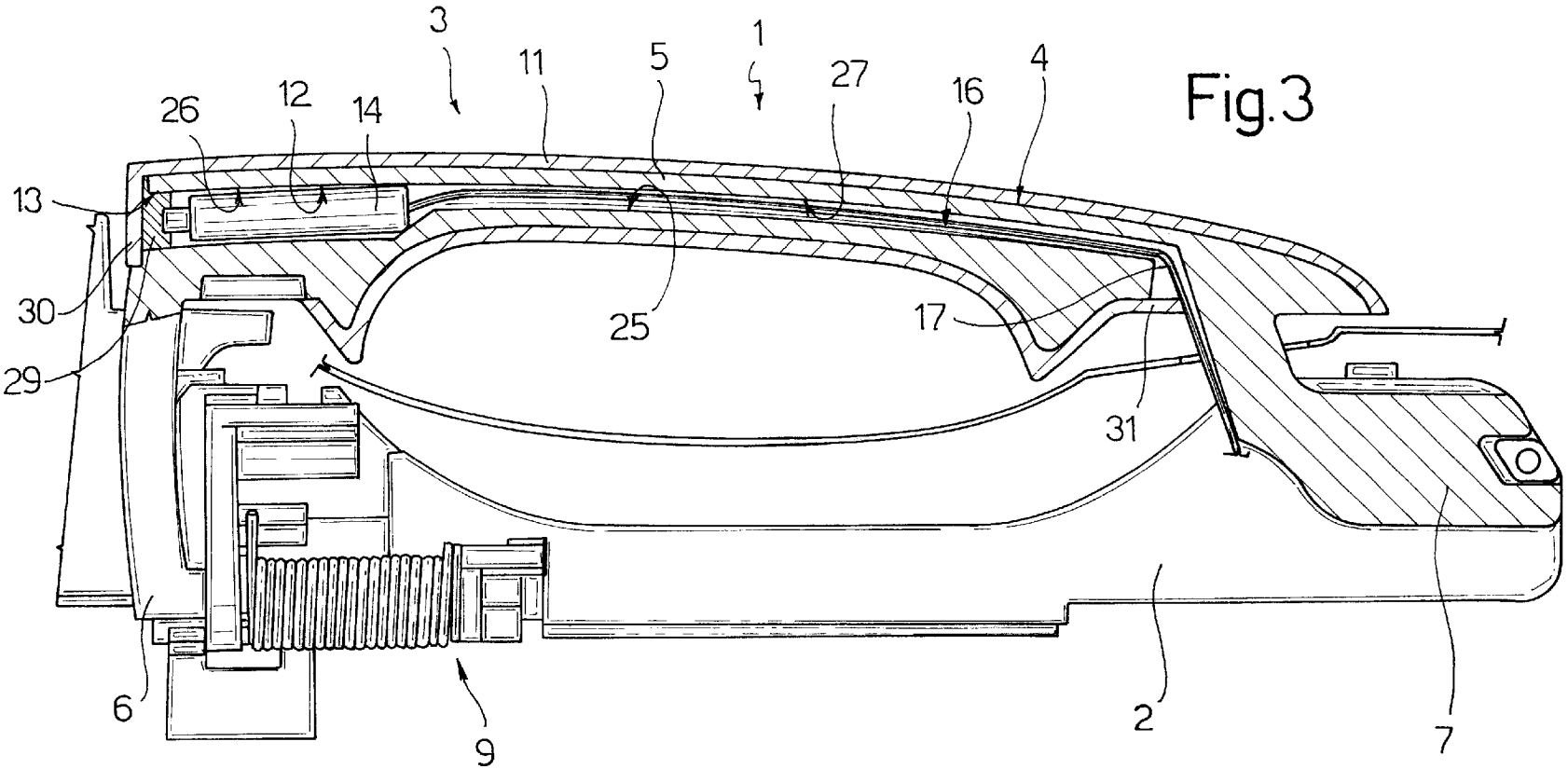

In the FIG. 3 variation, portion 5 of body 4 defines a through conduit 25, which extends substantially the whole length of portion 5 and comprises two portions 26 and 27; portion 26 having a larger diameter than portion 27 and defining seat 12; and portion 27 being engaged by cable 17. As shown in FIG. 3, portion 26 houses a plugging body 29, which is conveniently made of thermally or other insulating material, partly defines seat 12, and in turn houses an end portion of aerial 14 to maintain aerial 14 in a fixed position inside the lever. Plugging body 29 is also covered externally by a respective portion 30 of cover layer 11 to seal the end of conduit 25. Cover layer 11 also comprises a further portion 31, in which an intermediate portion of cable 16 is embedded, and which closes the opposite end of conduit 25 in fluidtight manner.

At the production stage, once body 4 is formed, aerial 14 is inserted inside portion 26, and cable 17 is threaded along portion 27 and out through the opposite end of conduit 25 to that in which aerial 14 is inserted. At this point, plugging body 29 is inserted inside portion 26 to secure aerial 14 inside portion 26, and portion 5 of body 4 is then covered with layer 11 to perfectly seal the whole of conduit 25.

Layer 11 of handle 1 described therefore provides for housing aerial 14 inside a respective sealed chamber, thus enabling aerial 14 to operate at all times in the best possible, i.e. dampfree, conditions, as well as for enabling the formation of a lever with a seamless outer surface, i.e. with no breaks such as lines and/or grooves, and hence a handle of a highly attractive appearance.

As will be clear from the foregoing description, bodies 21 and 29 provide for separating aerial 14 from cover layer 11, and, in particular, define a heat barrier for protecting aerial 14 from heat during the formation of layer 11. Bodies 21 and 29 therefore enable any type of aerial to be used, including those particularly sensitive to variations in temperature.

Clearly, changes may be made to handle 1 as described herein without, however, departing from the scope of the present invention. In particular, the cover layer may extend along only part of portion 5 and, at any rate, only along the part necessary to close the openings connecting the seat to the outside and to make the seat airtight. Moreover, a number of cover layers may be formed, and provision made for a number of spacer bodies other than that shown.

What is claimed is:

1. A handle (1) for a vehicle door, the handle (1) comprising a movable member (3) operated manually by a user to control, in use, a lock on said door, and said movable member (3) comprising a strengthening body (4), a seat (12) formed in said strengthening body (4) and having a respective access opening (13), detecting means (14) for identifying the user and housed inside said seat (12) through said access opening (13), and closing means (11); (11,21); (11, 29) for closing said access opening (13); characterized in that said closing means comprise at least one continuous layer (11) of material at least partly surrounding said strengthening body (4) and sealing said seat (12) in fluidtight manner.

2. A handle as claimed in claim 1, characterized in that said closing means also comprise at least one spacer body (21) (29) interposed between said detecting means (14) and said layer (11) of material to separate the detecting means (14) from said layer (11) of material.

3. A handle as claimed in claim 2, characterized in that said spacer body (21) (29) at least partly defines said seat (12).

4. A handle as claimed in claim 2, characterized in that said spacer body (21) (29) is made of insulating material.

5. A handle as claimed in claim 4, characterized in that said insulating material is a thermally insulating material.

6. A handle as claimed in claim 1, characterized in that said strengthening body (4) at least partly defines a conduit (22) (27) engaged by a cable (17) of said detecting means (14); said layer (11) of material at least partly embedding said cable (17) and sealing said conduit (22)(27) in fluidtight manner.

* * * * *